US006589092B2

(12) United States Patent
Sawada et al.

(10) Patent No.: US 6,589,092 B2
(45) Date of Patent: Jul. 8, 2003

(54) CLEANING METHOD AND CLEANING APPARATUS OF SHADOW MASK

(75) Inventors: Yoshiaki Sawada, Himeji (JP); Kazumasa Hirayama, Ibo-gun (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 282 days.

(21) Appl. No.: 09/835,382

(22) Filed: Apr. 17, 2001

(65) Prior Publication Data

US 2001/0031601 A1 Oct. 18, 2001

(30) Foreign Application Priority Data

Apr. 18, 2000 (JP) ..... 2000-117035

(51) Int. Cl.[7] ..... H01J 9/38; H01T 21/04

(52) U.S. Cl. ..... 445/59; 445/60; 134/1; 134/184

(58) Field of Search ..... 445/59, 60; 134/1, 134/184

(56) References Cited

U.S. PATENT DOCUMENTS 5,289,838 A * 3/1994 Odell ..... 134/184
5,379,785 A * 1/1995 Ohmori et al. ..... 134/184

FOREIGN PATENT DOCUMENTS

JP 01320731 A * 12/1989 ..... H01J/9/38
JP 04196219 A * 7/1992 ..... H01L/21/304

* cited by examiner

*Primary Examiner*—Kenneth J. Ramsey
*Assistant Examiner*—Mariceli Santiago
(74) *Attorney, Agent, or Firm*—Oblon, Spivak, McClelland, Maier & Neudstadt, P.C.

(57) ABSTRACT

An ultrasonic wave is oscillated from an ultrasonic generator toward a shadow mask to permit the ultrasonic wave to remove the foreign matter attached to the shadow mask, thereby cleaning the shadow mask. A part of the ultrasonic wave oscillated from the ultrasonic generator toward the shadow mask is reflected by a reflector toward the shadow mask so as to irradiate the shadow mask.

12 Claims, 7 Drawing Sheets

FIG. 5A
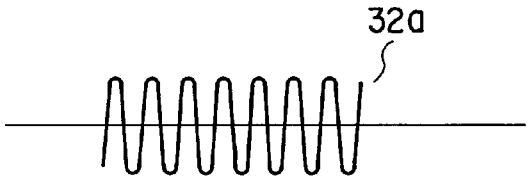
FIG. 5B
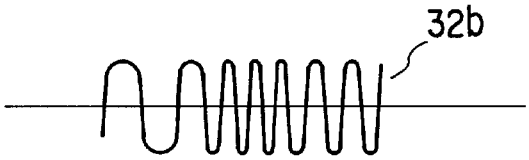
FIG. 5C
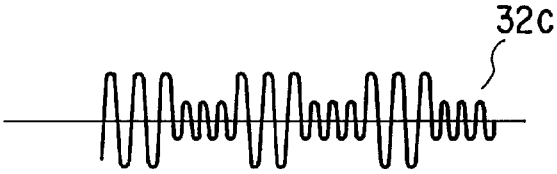
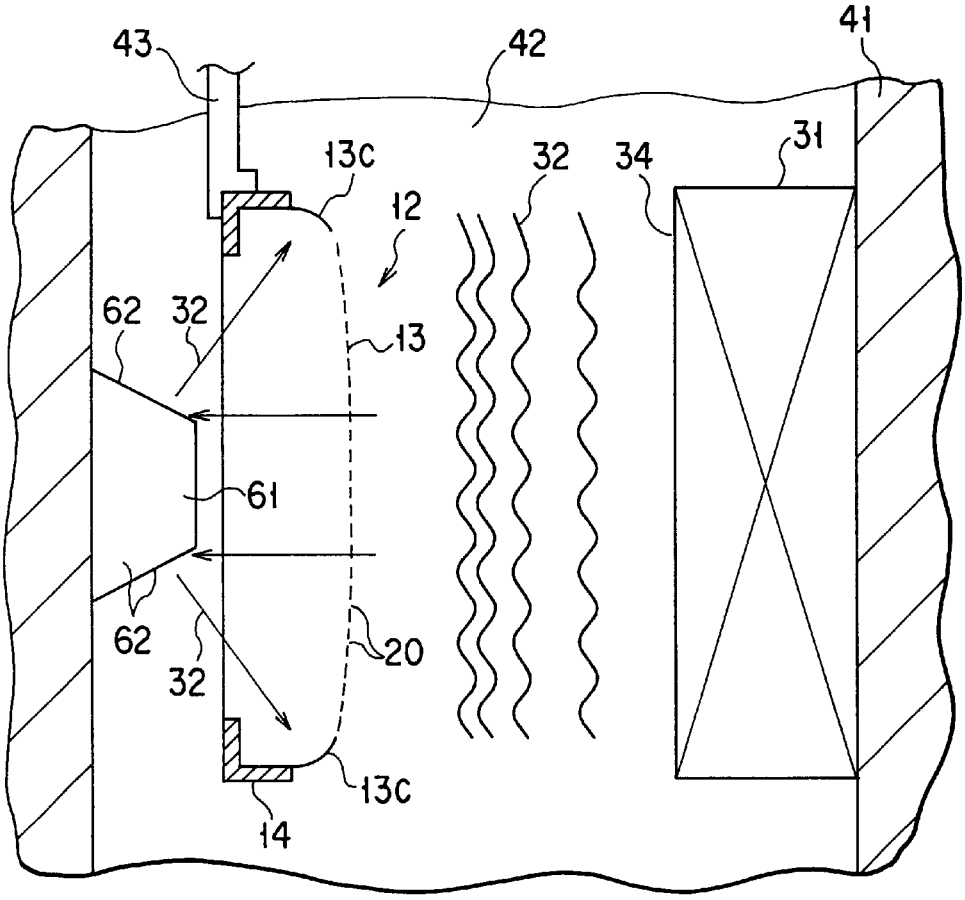
FIG. 6

CLEANING METHOD AND CLEANING APPARATUS OF SHADOW MASK

CROSS-REFERENCE TO RELATED APPLICATIONS

This application is based upon and claims the benefit of priority from the prior Japanese Patent Application No. 2000-117035, filed Apr. 18, 2000, the entire contents of which are incorporated herein by reference.

BACKGROUND OF THE INVENTION

The present invention relates to a method of cleaning a shadow mask, which is used in a cathode ray tube, by an ultrasonic and an apparatus for cleaning the shadow mask.

In general, a cathode ray tube used in a color television set or the like comprises a vacuum envelope including a panel and a funnel. A phosphor screen formed on the inner surface of the panel includes blue (B), green (G) and red (R) phosphor layers and black layers formed therebetween. A shadow mask is arranged inside the panel and opposite to the phosphor screen.

The shadow mask comprises a mask body, which has a mask surface where a number of electron beam passage apertures are formed and a skirt portion at the peripheral edge of the mask surface, and a mask frame, which is welded to the skirt portion of the mask body. Holders are welded to the respective corners of the mask frame. Further, panel pins provided on the inner wall of the panel are engaged in installation holes formed in the holder, respectively, thereby supporting the shadow mask at a predetermined position opposing the inner surface of the panel.

In the assembling process of the shadow mask, the mask body is formed into a predetermined shape by press-molding a raw material plate having a large number of electron beam passage apertures formed therein in advance. The formed mask body is cleaned and, then, subjected to a blackening treatment to have the surface covered with a blackening film consisting of an oxide film. The blackening film functions to prevent rust and reflection.

The mask frame of the shadow mask is also subjected to cleaning and process of blackening, after the press molding. The holder is welded to each corner or each side of the mask frame. This mask frame is welded to the outer surface of the skirt portion of the mask body at a plurality of positions. In general, the mask frame is formed of iron, and the mask body is formed of iron or Invar. Spot welding utilizing the resistance welding is adopted for the welding between the mask body and the mask frame.

The welding apparatus used for the spot welding comprises a pair of electrodes, i.e., a pressing-side electrode and a back electrode. In the welding step, the junction between the skirt portion of the shadow mask and the mask frame is held with a predetermined pressure between the pressing-side electrode and the back electrode. Under this state, voltage is applied between these two electrodes, with the result that the skirt portion and the mask frame are subjected to a resistance welding. To be more specific, if an electric current flows between the pressing-side electrode and the back electrode, the skirt portion and the mask frame are welded so as to form a welded portion called nugget.

It should be noted that, in the welding step, the blackening film poor in conductivity, which is formed on the surfaces of the mask body and the mask frame, is present between the pressing-side electrode and the back electrode. As a result, splashes are generated when the blackening film is broken and when the metals are welded to each other. The splashes thus generated are scattered on the mask surface so as to cause clogging of the electron beam passage apertures.

To be more specific, the mask body has a thickness of 0.1 to 0.25 mm, and a plurality of amphitheatric circular or rectangular openings each having a diameter of 100 to 200 $\mu$m are bored in the front and back surfaces of the mask body. Each of these openings has a larger diameter on the side of the surface facing the phosphor screen of the panel and a smaller diameter on the side of the surface facing the electron gun. Each of the electron passage apertures is defined by a pair of larger and smaller diameter openings. Further, in the welding step, splashes scattered from the welding portion onto the mask surface easily enter the smaller diameter openings or the larger diameter openings so as to causes clogging.

Particularly, since the welding points are positioned in the peripheral portion of the shadow mask, the clogging caused by the splashes tends to take place in the peripheral portion of the mask body. Also, the foreign matters such as the splashes tend to be accumulated in the clearance between the shadow mask and the mask frame.

On the other hand, in the manufacturing process of the cathode ray tube, the shadow mask is used for the formation of a phosphor screen. To be more specific, the phosphor screen is formed by exposing the phosphors of the three colors of blue, green and red to the light passing through the apertures of the shadow mask arranged to face the panel. It follows that, if the apertures of the mask body are clogged by the splashes, dust or other foreign matters, it is impossible to expose the phosphors to light in a desired pattern, resulting in formation of the phosphor screen having defects.

Under the circumstances, it is supposed to clean the shadow mask after the welding step so as to remove the foreign matters clogging the apertures. An ultrasonic cleaning within water may be employed for the cleaning.

In the ultrasonic cleaning treatment noted above, the shadow mask is held horizontal or vertical within water, and the shadow mask is irradiated with the ultrasonic wave oscillated from an ultrasonic generator so as to remove the foreign matters. For example, in the case of irradiating the ultrasonic wave from the side of the mask frame of the shadow mask, i.e., from the side of the smaller diameter openings on the inner surface of the mask body, the foreign matters clogging the larger diameter openings are removed by the ultrasonic wave passing through the smaller diameter openings.

However, the ultrasonic wave passing through the apertures of the shadow mask and the ultrasonic wave passing outside the shadow mask are not effectively utilized by simply oscillating the ultrasonic wave from the ultrasonic generator toward the shadow mask as described above. It is difficult to achieve an effective irradiation of the ultrasonic wave in that portion of the shadow mask which is difficult to be irradiated with the ultrasonic wave, giving rise to the problem that the shadow mask cannot be cleaned sufficiently.

Particularly, where the shadow mask is irradiated with the ultrasonic wave coming from the side of the smaller diameter openings on the inner surface of the mask body, the mask frame, which is obstructive, causes the peripheral portion of the mask body to be unlikely to be irradiated with the ultrasonic wave, resulting in failure to clean sufficiently the entire mask body.

BRIEF SUMMARY OF THE INVENTION

The present invention has been contrived in consideration of the above circumstances, and its object is to provide a method of cleaning a shadow mask without fail and a cleaning apparatus of the shadow mask.

In order to achieve the above object, a cleaning method according to the present invention comprises:

arranging a shadow mask including a mask body having electron beam passage apertures formed therein and a mask frame fixed to the peripheral portion of the mask body within an ultrasonic wave transmitting medium;

oscillating an ultrasonic wave from an ultrasonic generator toward the shadow mask; and allowing an ultrasonic wave reflector to reflect at least partially the ultrasonic wave oscillated from the ultrasonic generator toward the shadow mask.

A cleaning apparatus according to the present invention comprises:

a holding section for holding a shadow mask within an ultrasonic wave transmitting medium;

an ultrasonic generator for oscillating an ultrasonic wave toward the shadow mask; and an ultrasonic wave reflector for reflecting at least partially the ultrasonic wave oscillated from the ultrasonic generator toward the shadow mask.

According to the cleaning method and the cleaning apparatus of the present invention, an ultrasonic wave is oscillated from an ultrasonic generator toward a shadow mask so as to permit the ultrasonic wave to remove the foreign matters attached to the shadow mask, thereby cleaning the shadow mask. Also, the ultrasonic wave oscillated from the ultrasonic generator is reflected at least partially toward the shadow mask so as to effectively utilize the ultrasonic wave and, thus, to wash the shadow mask without fail.

Also, according to the present invention, the ultrasonic wave reflector reflects partially the ultrasonic wave oscillated from the ultrasonic generator toward the peripheral portion of the mask body, thereby permitting the peripheral portion of the mask body, which is unlikely to be irradiated directly with the ultrasonic wave oscillated from the ultrasonic generator, to be irradiated with the ultrasonic wave sufficiently, thereby cleaning the shadow mask without fail.

Also, according to the present invention, the ultrasonic wave reflector reflects the ultrasonic wave passing through the electron beam passage apertures of the shadow mask or reflects directly the ultrasonic wave oscillated from the ultrasonic generator so as to permit the shadow mask to be irradiated with the ultrasonic wave, thereby effectively utilizing the ultrasonic wave.

Further, according to the cleaning method and the cleaning apparatus of the present invention, the relative positions of the shadow mask and the ultrasonic wave reflector are changed so as to change the position of the shadow mask irradiated with the ultrasonic wave reflected from the ultrasonic wave reflector. As a result, a wide range of the shadow mask is irradiated with the ultrasonic wave and the ultrasonic wave irradiation is intensified or weakened at a desired area of the shadow mask so as to efficiently clean the shadow mask.

It follows that the present invention provides a cleaning method and a cleaning apparatus that can sufficiently clean the shadow mask, and also provides a high quality shadow mask free from the difficulties such as the clogging.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 5A to 5C show the waveforms of the ultrasonic waves used in the cleaning apparatus shown in FIG. 4;

FIG. 6 is a cross sectional view schematically showing the construction of an ultrasonic wave cleaning apparatus according to a second embodiment of the present invention;

DETAILED DESCRIPTION OF THE INVENTION

Figure 1:
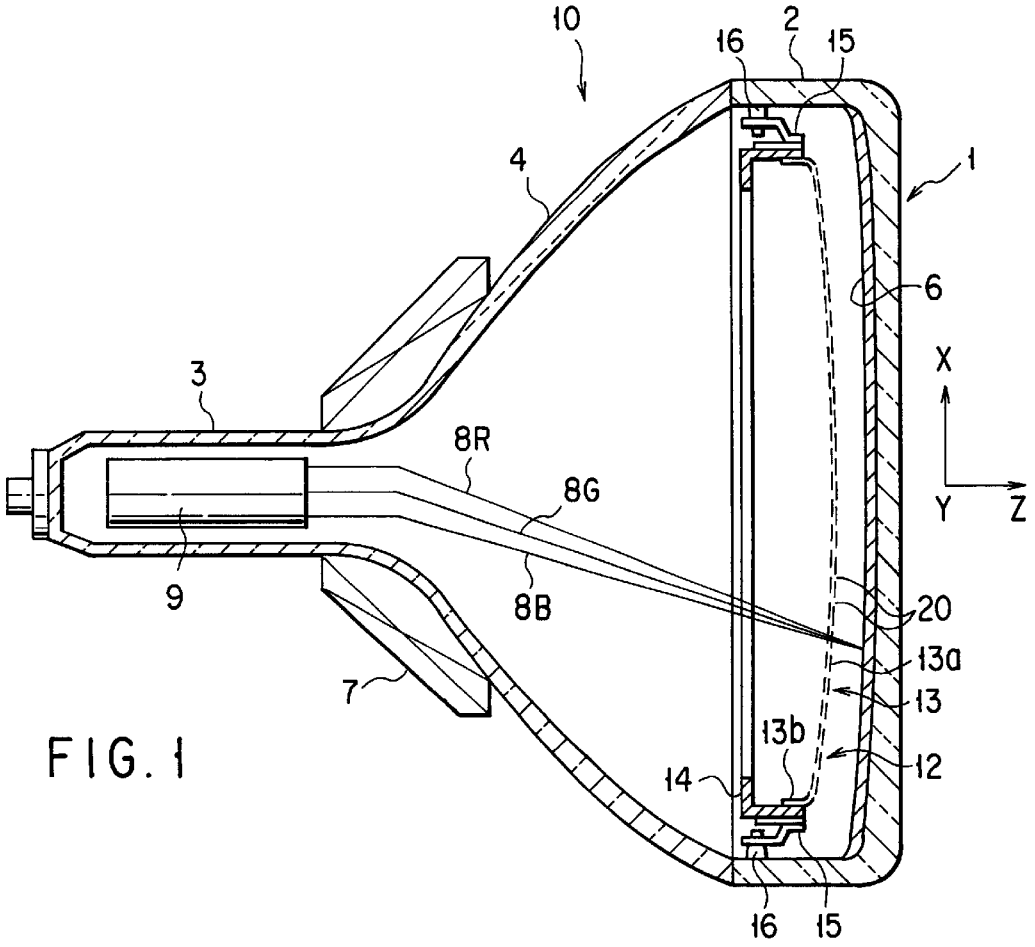
FIG. 1 is a cross sectional view showing a cathode ray tube equipped with a shadow mask.

Some embodiments of the present invention will now be described with reference to the accompanying drawings. A color cathode ray tube equipped with a shadow mask will now be described first. As shown in FIG. 1, a color cathode ray tube comprises a vacuum envelope 10 including a substantially rectangular panel 1 having a substantially flat outer surface and including a skirt portion 2 positioned in the periphery, a funnel 4 contiguous to the skirt portion 2 of the panel 1, and a cylindrical neck 3 connected to the small diameter portion of the funnel 4.

A phosphor screen 6 comprising a plurality of dot-like phosphor layers emitting red, green and blue lights and black layers formed between the adjacent phosphor layers is formed on the inner surface of the panel 1. A deflection yoke 7 having horizontal and vertical deflection coils is mounted on the outer circumferential surface of that region of the vacuum envelope 10 which ranges between the neck 3 and the funnel 4. Also, an electron gun 9 for emitting three electron beams 8R, 8G and 8B toward the phosphor layers of the phosphor screen 6 is arranged within the neck 3.

Figure 2:
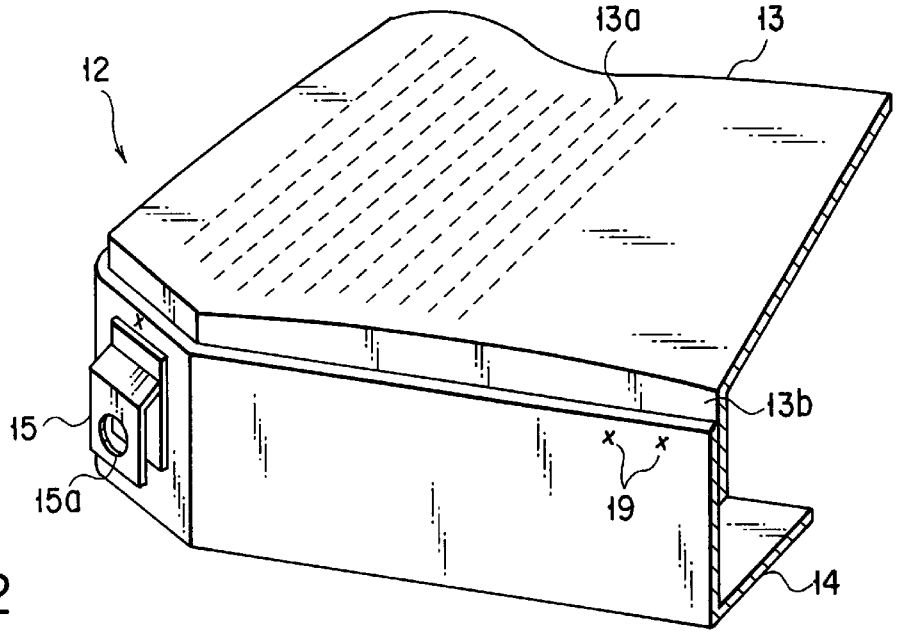
FIG. 2 is an oblique view showing a part of the shadow mask.

A shadow mask 12 is arranged within the vacuum envelope 10 in a manner to face the phosphor screen 6. The shadow mask 12 comprises a rectangular mask body 13 formed of iron or Invar and a mask frame 14 mounted to the periphery of the mask body 13. As shown in FIGS. 1 and 2, the mask body 13, which is positioned to face the phosphor screen 6, comprises a rectangular mask effective portion 13*a* in which a large number of electron beam passage apertures 20 are formed and a skirt portion 13*b* formed by folding the peripheral portion of the mask effective portion 13*a*. The mask frame 14, which is formed of, for example, iron, is arranged outside the skirt portion 13*b* of the mask body 13 and is welded to the skirt portion 13*b* at a plurality of points 19.

A holder 15 used as an elastic support member is welded to each corner portion of the mask frame 14. An installation hole 15*a* is formed in the holder 15. Also, the shadow mask 12 is detachably supported in a predetermined position facing the inner surface of the panel 1 by allowing a stud pin 16 projecting inward from the inner surface of the skirt portion 2 of the panel 1 to be engaged with the installation hole 15*a* of the holder 15.

In the color cathode ray tube of the construction described above, the three electron beams 8B, 8G and 8R emitted from the electron gun 9 are deflected by the deflection yoke 7 mounted to the outer circumferential surface of the funnel 4 so as to be scanned in the horizontal and vertical directions of the phosphor screen 6 through the electron beam passage apertures 20 of the shadow mask 12, thereby displaying a color image.

The construction of the shadow mask 12 will now be described in detail.

Figure 3:
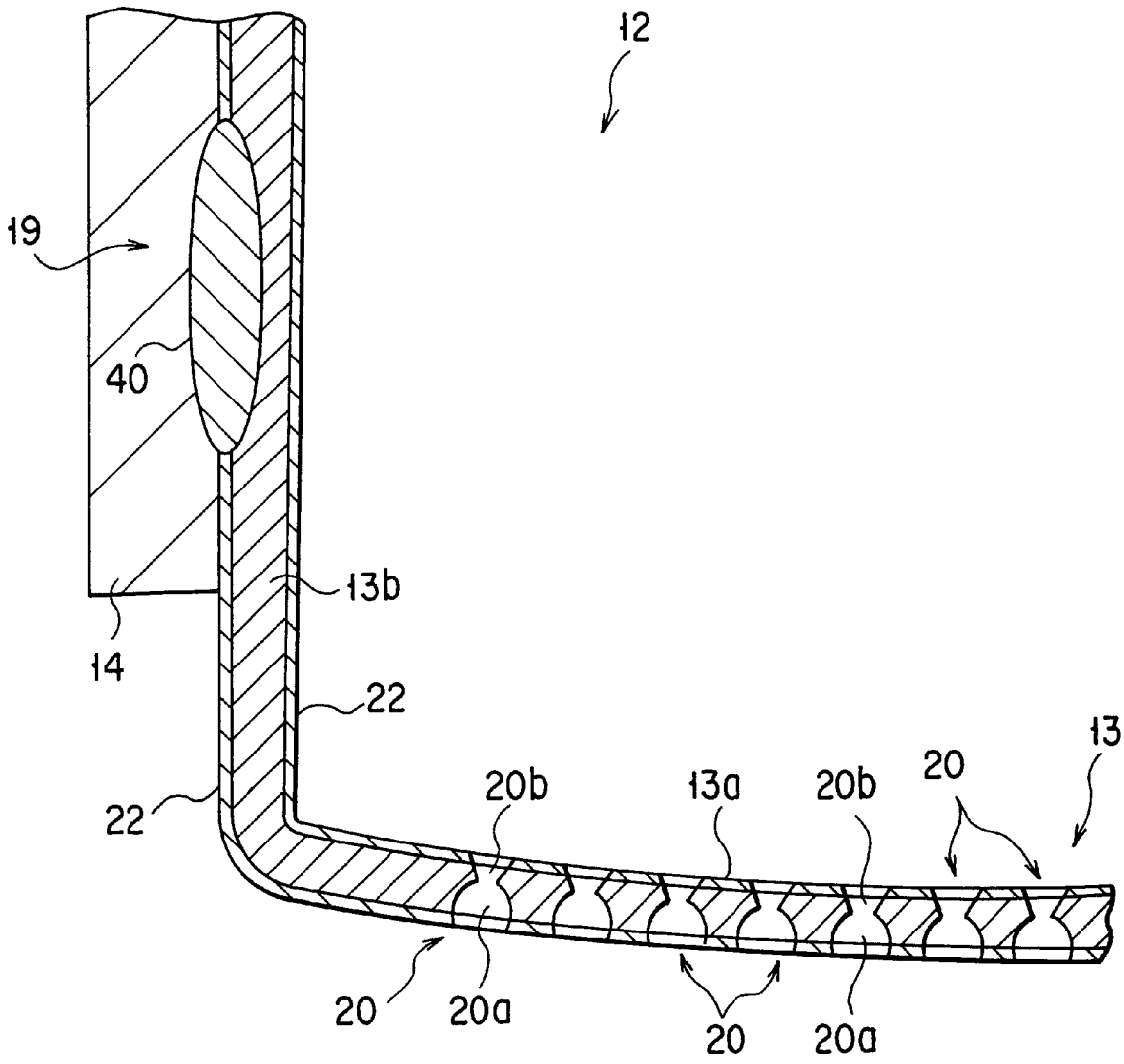
FIG. 3 is a cross sectional view showing in a magnified fashion a part of the shadow mask.

As shown in FIGS. 1 to 3, the mask effective portion 13*a* of the mask body 13 is formed in a predetermined curvature, and a large number of electron beam passage apertures 20 are regularly formed at the mask effective portion 13*a*. The mask body 13 has a thickness of 0.1 to 0.2 mm and is formed in a predetermined shape by a press molding. A blackening film 22, which is formed on each of the inner surface and the outer surface of the mask body 13, serves to prevent rust and reflection.

Each of the electron beam passage apertures 20 is an amphitheatric circular or rectangular aperture having a diameter of about 100 to 200 $\mu$m, and comprises a larger diameter opening 20*a* positioned to face the phosphor screen 6 of the panel 1 and a smaller diameter opening 20*b* positioned to face the electron gun 9.

The mask frame 14 supporting the mask body 13 has a thickness of about 0.8 to 1.2 mm and is formed substantially rectangular by a press molding. Also, a blackening film is formed on the surface of the mask frame 14. The mask frame 14 is welded to the skirt portion 13*b* of the mask body 13 in a plurality of welded portions 19. A spot welding utilizing resistance welding is employed for the welding of the mask frame 14 to the mask body 13.

The ultrasonic cleaning method and the ultrasonic cleaning apparatus of the shadow mask, which are employed in the manufacturing process of the shadow mask used in the color cathode ray tube, will now be described.

Figure 4:
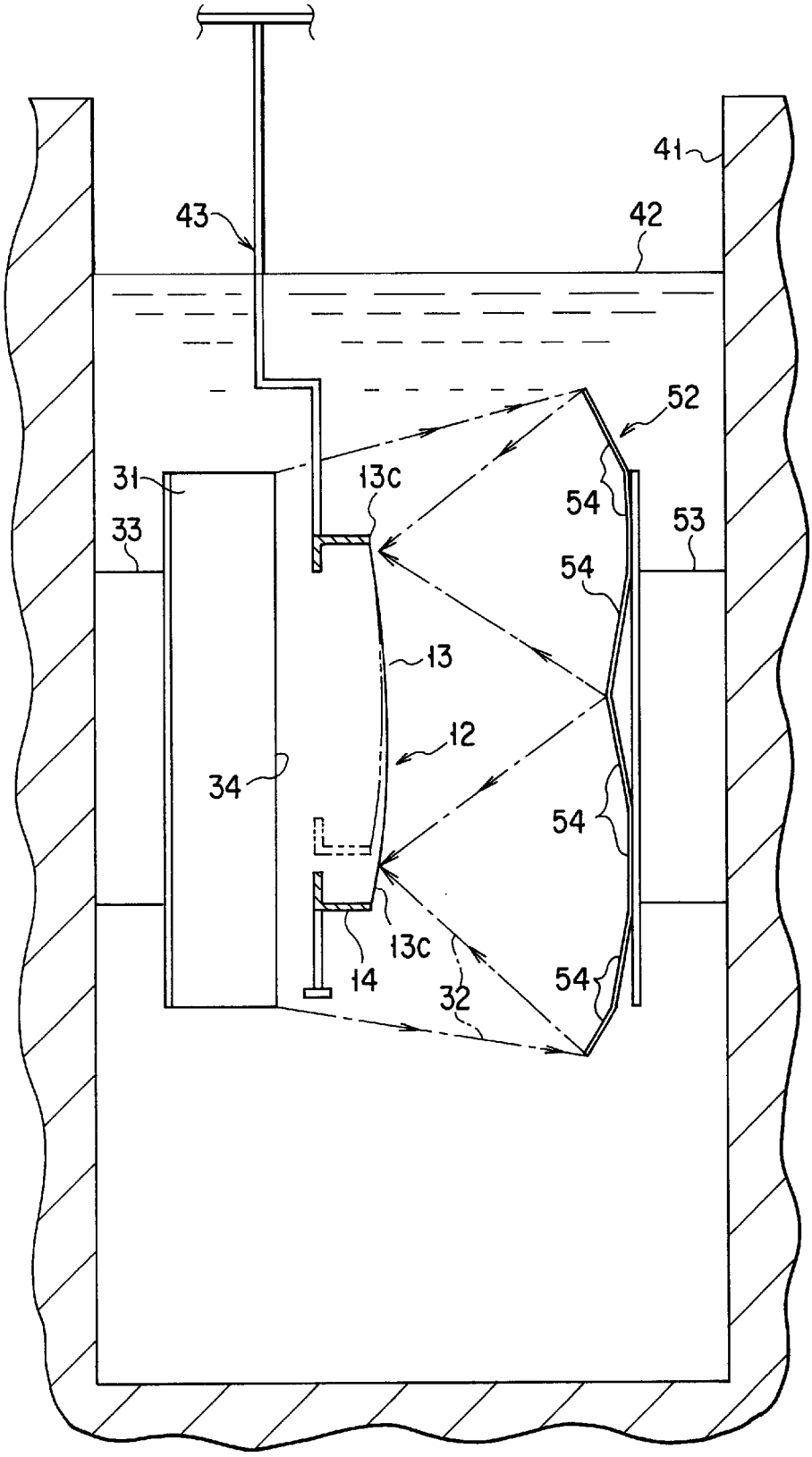
FIG. 4 is a cross sectional view showing an ultrasonic cleaning apparatus according to a first embodiment of the present invention.

As shown in FIG. 4, the ultrasonic cleaning apparatus comprises a processing vessel 41 storing liquid 42 such as water as an ultrasonic wave transmitting medium. After the mask frame 14 is welded to the mask body 13, the shadow mask 12 is subjected to an ultrasonic cleaning treatment within the liquid 42. It is possible to use, for example, a cleaning solution, as the ultrasonic wave transmitting medium in stead of water.

The ultrasonic cleaning apparatus comprises a transfer mechanism 43, which holds the mask frame 14 of the shadow mask 12 so as to support the shadow mask in a substantially vertically hung state, thereby transferring the shadow mask 12 in accordance with the batch processing of a plurality of processing steps. In the ultrasonic cleaning process, the transfer mechanism 43 transfers the shadow mask 12 from outside the processing vessel 41 into the processing vessel 41 so as to dip the shadow mask 12 in the liquid 42 housed in the processing vessel 41. Then, the transfer mechanism 43 holds the shadow mask 12 in a predetermined ultrasonic cleaning position and, after the processing, pulls up the shadow mask 12 so as to transfer the shadow mask 12 to the succeeding process step. Also, the transfer mechanism 43 supports and transfers various shadow masks differing from each other in size based on the upper end of the shadow mask 13 held in a hung state. Incidentally, FIG. 4 shows a shadow mask 13 denoted by a solid line and another shadow mask smaller than the shadow mask 13 and denoted by a two dots-and-dash line.

The ultrasonic cleaning apparatus also comprises an ultrasonic generator 31 and a reflecting plate 52, which are arranged within the processing vessel 41. The ultrasonic generator 31 is arranged on one side within the processing vessel 41 and is supported on the inner surface of the processing vessel via a supporting member 33. The ultrasonic generator 31 comprises an oscillating surface 34 extending substantially vertical and larger than the outer size of the shadow mask 12. An ultrasonic wave 32 is oscillated from the oscillating surface 34 toward the shadow mask 13.

The ultrasonic wave used in the present invention includes an ultrasonic wave 32*a* having a single frequency as shown in FIG. 5A, an ultrasonic wave 32*b* in which a high frequency and a low frequency occur alternately as shown in FIG. 5B, and an ultrasonic wave 32*c* in which the output amplitude is increased or decreased as shown in FIG. 5C.

The reflecting plate 52 functioning as a reflector is arranged on the other side within the processing vessel 41. The reflecting plate 52 is supported to the inner surface of the processing vessel 41 via a supporting section 53. It should be noted that the reflecting plate 52 is positioned to face the oscillating surface 34 of the ultrasonic generator 31. The reflecting plate 52 is formed of, for example, a stainless steel and includes a plurality of reflecting surfaces 54. The reflecting plate 52 is similar as a whole to the outer configuration of the shadow mask 12 hanging from the transfer mechanism 43. Also, at least a part of the reflecting surfaces 54 is inclined relative to the propagating direction of the ultrasonic wave oscillated from the ultrasonic generator 31.

The reflecting plate 52 is constructed such that the ultrasonic wave 32 passing through the electron beam passage apertures 20 of the shadow mask 12 and the ultrasonic wave 32 passing outside the shadow mask 12 are reflected by the plural reflecting surfaces 54 toward the peripheral portion 13*c* of the shadow mask 12. In this case, the ultrasonic wave 32 is reflected by the reflecting plate 52 in a direction differing from the incident direction, with the result that it is possible to prevent the ultrasonic wave 32 oscillated from the ultrasonic generator 31 and the reflected ultrasonic wave 32 from being weakened each other and, thus, from being attenuated.

Where an ultrasonic cleaning is applied to the shadow mask 12 by the ultrasonic cleaning apparatus of the construction described above, the shadow mask 12 is dipped by the transfer mechanism 43 in the liquid 42 stored in the processing vessel 41 and arranged in a predetermined position between the ultrasonic generator 31 and the reflecting plate 52. In this case, the shadow mask 12 is arranged such that the inner surface of the shadow mask 12, i.e., the surface on which the smaller diameter openings 20*b* are open, are positioned to face the oscillating surface 34 of the ultrasonic generator 31.

Under this state, the ultrasonic wave 32 is oscillated from the ultrasonic generator 31 toward the shadow mask 12. The oscillated ultrasonic wave 32 is transmitted through the transmitting medium of the liquid 42 so as to irradiate directly the inner surface of the shadow mask 12 with the ultrasonic wave 32. As a result, the ultrasonic wave 32 is transmitted through the smaller diameter opening 20*b* and the larger diameter opening 20*a* of each of the electron beam passage apertures 20. Where the larger diameter opening 20*a* is clogged with a foreign matter, the foreign matter is removed by the ultrasonic wave 32 from within the larger diameter opening 20*a* to the outside.

The ultrasonic wave 32 passing through the electron beam passage apertures 20 of the shadow mask 12 and the ultrasonic wave 32 passing outside the shadow mask 12 are incident on the reflecting plate 52 and reflected by the reflecting plate 52 toward the peripheral portion 13*c* of the shadow mask 12. The reflected ultrasonic wave 32 passes through the larger diameter openings 20*a* and the smaller diameter openings 20*b*. Where the smaller diameter opening 20*b* is clogged with a foreign matter, the foreign matter is removed by the ultrasonic wave 32 from within the opening 20*b* to the outside. In this case, the foreign matter present in the peripheral portion of the mask body 13 such as the clearance between the peripheral portion of the mask body 13 and the mask frame 14 is also removed by the ultrasonic wave 32.

It should be noted that the ultrasonic wave 32 reflected from the reflecting surface 54 maintains an output substantially equal to that of the ultrasonic wave incident on the reflecting surface 54, with the result that the reflected ultrasonic wave 32 produces the cleaning effect substantially equal to that produced by the ultrasonic wave 32 emitted from the ultrasonic generator 31 for directly irradiating the shadow mask 12.

The lower end position of the shadow mask 12 hung from the transfer mechanism 43 differs depending on the size of the shadow mask. It should be noted, however, that a peripheral portion 13*c* of the shadow mask of a differing size can be irradiated sufficiently with the ultrasonic wave 32 by allowing the reflecting plate 52 to reflect the ultrasonic wave 32 toward the intermediate portion of the ultrasonic generator 31.

It is possible to apply a second cleaning treatment to the shadow mask 12. Specifically, after completion of the cleaning treatment described above, the shadow mask 12 is pulled out of the processing vessel 41 by the transfer mechanism 43. Then, the direction of the shadow mask is changed by 180° and the shadow mask 12 is arranged again between the ultrasonic generator 31 and the reflecting plate 52 within the processing vessel 41 for applying a second cleaning treatment to the shadow mask 12.

Alternatively, it is possible to apply the second cleaning treatment by also using a second processing vessel opposite to the processing vessel 41 in the arrangement of the ultrasonic generator and the reflecting plate, the processing vessel 41 and the second processing vessel being arranged side by side. In this case, the shadow mask 12 pulled out of the processing vessel 41 by the transfer mechanism 43 is arranged between the ultrasonic generator and the reflecting plate within the second processing vessel without changing the direction of the shadow mask 12 for application of the second cleaning treatment to the shadow mask 12.

In any of the cases described above, the shadow mask 12 is positioned to permit the inner surface to face the reflecting plate 52 and to permit the outer surface to face the ultrasonic generator 31. Under this state, the ultrasonic wave 32 is emitted from the ultrasonic generator 31 toward the shadow mask 12. The oscillated ultrasonic wave 32 irradiates directly the outer surface of the shadow mask 12, i.e., on the side of the larger diameter opening 20*a* of each of the electron beam passage aperture 20, and passes through the larger diameter opening 20*a* and the smaller diameter opening 20*b* in the order mentioned. Where the smaller diameter opening 20*b* is clogged with a foreign matter, the foreign matter is removed from within the opening 20*b* to the outside by the ultrasonic wave 32.

The ultrasonic wave 32 passing through the electron beam passage aperture 20 of the shadow mask 12 and the ultrasonic wave 32 passing outside the shadow mask 12 are reflected by the reflecting plate 52 toward the peripheral portion 13*c* of the shadow mask 12. The reflected ultrasonic wave 32 passes through the smaller and larger diameter openings 20*b* and 20*a*, in the order mentioned, of each of the electron beam passage apertures 20. If the larger diameter opening 20*a* is clogged with a foreign matter, the foreign matter is removed from within the larger diameter opening 20*a* by the ultrasonic wave 32. In addition, the foreign matter present in the peripheral portion 13*c* of the shadow mask 12 such as the clearance between the mask frame 14 and the mask body 13 can also be removed by the ultrasonic wave 32.

According to the ultrasonic cleaning method and the ultrasonic cleaning apparatus of the construction described above, the ultrasonic wave 32 oscillated from the ultrasonic generator 31 toward the shadow mask 12 is partly reflected toward the peripheral portion 13*c* of the shadow mask 12 so as to clean the shadow mask by effectively utilizing the ultrasonic wave 32. For example, the peripheral portion 13*c* of the shadow mask 12 is unlikely to be irradiated directly with the ultrasonic wave 32 oscillated from the ultrasonic generator 31 because of the presence of the mask frame 14. In the present invention, however, the peripheral portion 13*c* of the shadow mask 12 can also be irradiated sufficiently with the ultrasonic wave 32, making it possible to remove easily the foreign matter attached to the peripheral portion 13*c* of the shadow mask 12. It follows that the shadow mask 12 can be sufficiently cleaned without fail so as to prevent the clogging of the electron beam passage apertures, thereby improving the yield of the shadow mask. According to the present embodiment, inferior of the shadow mask due to clogging of the electron beam passage apertures was improved about 6%.

It should also be noted that the ultrasonic wave passing through the electron beam passage apertures 20 of the shadow mask 12 and the ultrasonic wave passing outside the shadow mask are reflected so as to utilized again for the cleaning of the shadow mask. As a result, the cleaning efficiency is improved and the cleaning time can be shortened. In addition, the cleaning can be achieved without fail even if the output of the ultrasonic wave is lowered.

Incidentally, in the case of using the ultrasonic wave 32*b* having the frequency changed or the ultrasonic wave 32*c* having the output power changed as the ultrasonic wave 32 shown in FIGS. 5B and 5C, it is possible to improve the cleaning effect.

An ultrasonic cleaning method and an ultrasonic cleaning apparatus according to a second embodiment of the present invention will now be described.

Figure 7:
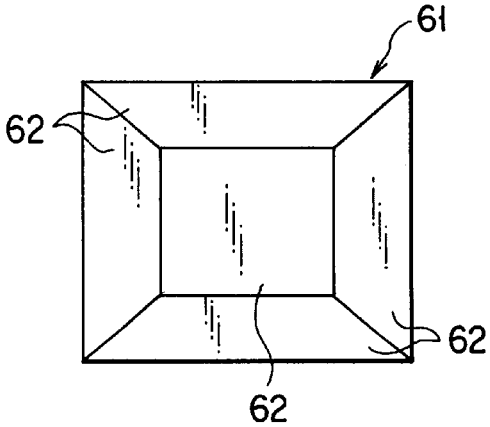
FIG. 7 is a plan view showing the reflecting blocks of the ultrasonic cleaning apparatus according to the second embodiment of the present invention.

As shown in FIGS. 6 and 7, the ultrasonic cleaning apparatus according to the second embodiment of the present invention is constructed such that the ultrasonic generator 31 is arranged within the processing vessel 41 in a manner to face the outer surface of the shadow mask 12, i.e., in a manner to face the larger diameter opening 20*a* of each of the electron beam passage apertures 20, and that a reflecting block 61 performing the function of a reflector is arranged to face the inner surface of the shadow mask, i.e., to face the smaller diameter opening 20*b* of each electron beam passage aperture 20. The reflecting block 61, which is made of, for example, a stainless steel, is formed in the shape of a truncated pyramid, which is similar to the outer configuration of the shadow mask 12. Each outer surface of the truncated pyramid forms a reflecting surface 62 for reflecting the ultrasonic wave toward the inside of the peripheral portion 13*c* of the mask body 13. Also, the reflecting block 61 is arranged such that the reflecting surface 62 positioned on the tip portion is perpendicular to the propagating direction of the ultrasonic wave 32 oscillated from the ultrasonic generator 31, and the surrounding reflecting surfaces 62 are inclined relative to the propagating direction of the ultrasonic wave 32.

The second embodiment is equal to the first embodiment in the other constructions and, thus, the same reference numerals are put to the same members so as to avoid the overlapping description.

According to the second embodiment, the ultrasonic wave 32 oscillated from the ultrasonic generator 31 is transmitted through the transmitting medium of the liquid 42 and irradiated directly the outer surface of the shadow mask 12 and, then, passes through the larger diameter openings 20*a* and, then, through the smaller diameter openings 20*b* of the electron beam passage apertures 20. Where the smaller diameter opening 20*b* is clogged with a foreign matter in this case, the foreign matter is removed from within the opening 20*b* by the ultrasonic wave 32.

The ultrasonic wave 32 passing through the electron beam passage apertures 20 of the shadow mask 12 is reflected partly by the reflecting surfaces 62 of the reflecting block 61 toward the inner surface of the peripheral portion 13*c* of the mask body 13, and passes through the smaller diameter openings 20*b* and, then, through the larger diameter opening 20*a* of the electron beam passage apertures 20. Where the larger diameter opening 20*a* is clogged with a foreign matter, the foreign matter is removed from within the opening 20*a* by the ultrasonic wave 32. It is also possible to remove the foreign matter present on the inner surface in the peripheral portion of the shadow mask 12 such as the clearance between the mask frame 14 and the mask body 13. It should also be noted that a part of the ultrasonic wave 32 reflected from the reflecting block 61 irradiates the inner surface of the peripheral portion 13*c* of the shadow mask 12 in a direction substantially perpendicular to the inner surface of the peripheral portion 13*c* so as to facilitate the removal of the foreign matter. It follows that the shadow mask 12 can be washed without fail.

Figure 8:
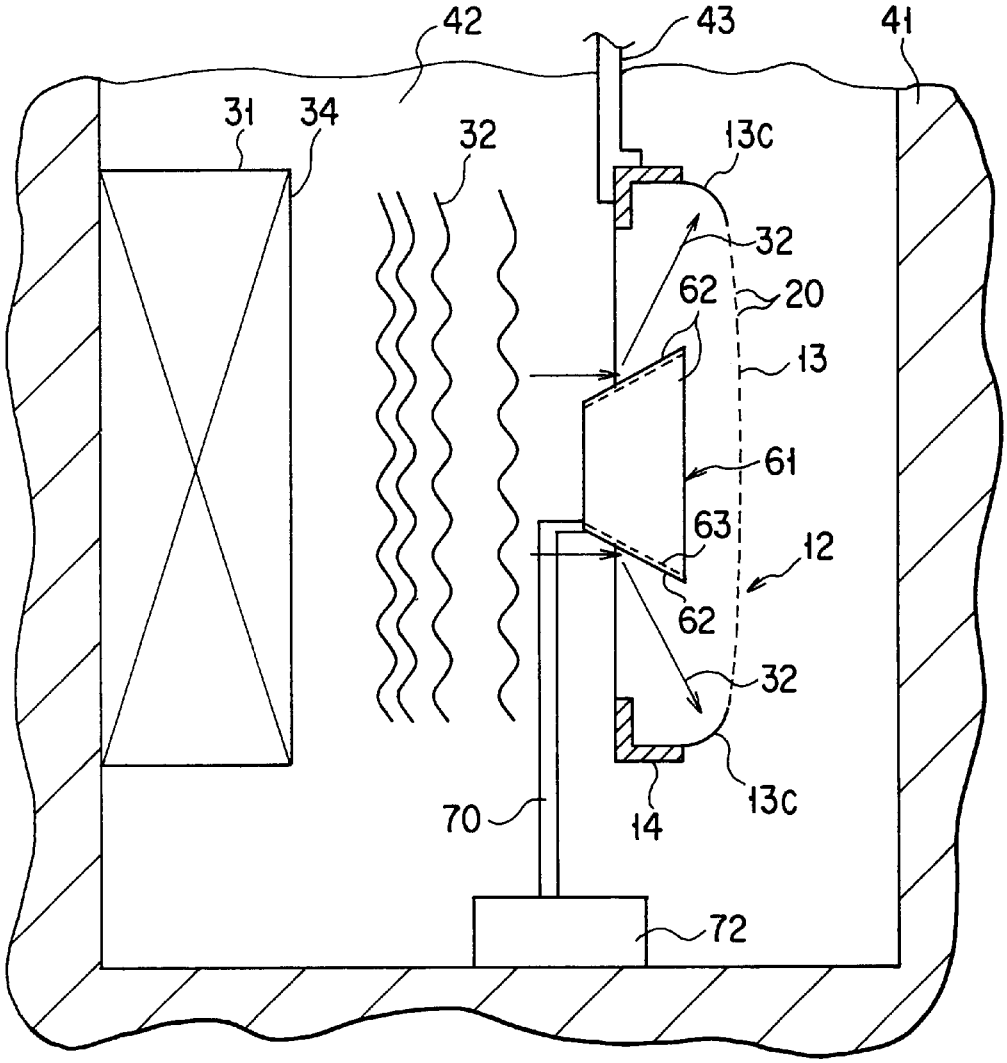
FIG. 8 is a cross sectional view schematically showing the construction of an ultrasonic cleaning apparatus according to a third embodiment of the present invention.
Figure 9:
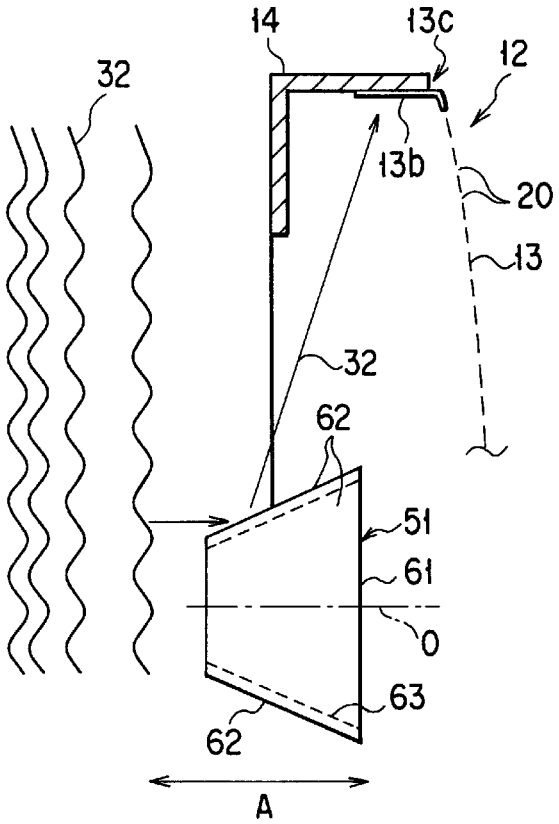
FIG. 9 is a cross sectional view showing in a magnified fashion a part of the ultrasonic cleaning apparatus according to the third embodiment of the present invention.

FIGS. 8 and 9 collectively show a third embodiment of the present invention. In this embodiment, a ultrasonic generator 31 is arranged within the processing vessel 41 in a manner to face the inner surface of the shadow mask 12. Also, a reflecting block 61 is arranged between the shadow mask 12 and the ultrasonic generator 31. The reflecting block 61, which is made of, for example, a stainless steel, is formed in the shape of a hollow truncated pyramid having a through-hole 63 open in the bottom portion and in the top portion. Each outer surface of the reflecting block 61 forms a reflecting surface 62 for reflecting the ultrasonic wave 32 toward the inner surface of the peripheral portion 13*c* of the mask body 13.

The reflecting block 61 is arranged such that the axis 0 of the reflecting block 61 is substantially parallel to the propagating direction of the ultrasonic wave 32 oscillated from the ultrasonic generator 31 and extends through substantially the center of the oscillating surface 34. Because of the particular construction, the reflecting surfaces 62 of the reflecting block 61 are inclined relative to the propagating direction of the ultrasonic wave 32. Further, the reflecting block 61 is supported by a supporting rod 70 of a driving mechanism 72. The driving mechanism 72 permits the reflecting block 61 to be capable of a reciprocating movement in a direction parallel to the axis 0 as denoted by an arrow A.

The third embodiment is equal to the first embodiment in the other constructions and, thus, the same reference numerals as in the first embodiment are put to the same members so as to avoid the overlapping description.

According to the third embodiment of the construction described above, the ultrasonic wave 32 oscillated from the ultrasonic generator 31 irradiates directly the inner surface of the shadow mask 12 so as to pass through the smaller diameter opening 20*b* and, then, through the larger diameter opening 20*a* of each of the electron beam passage apertures 20. Where the larger diameter opening 20*a* is clogged with a foreign matter in this step, the foreign matter is removed from within the larger diameter opening 20*a* by the ultrasonic wave 32. Also, a part of the ultrasonic wave 32 oscillated from the ultrasonic generator 31 is reflected by the reflecting surface 62 of the reflecting block 61 toward the inner surface of the peripheral portion 13*c* of the shadow mask 12, the inner surface being positioned behind the mask frame 14. In this case, the reflected ultrasonic wave 32 passes through the smaller diameter openings 20*b* and, then, through the larger diameter openings 20*a* of the electron beam passage apertures 20 in the peripheral portion of the mask body 13. Where the larger diameter opening 20*a* is clogged with a foreign matter in this step, the foreign matter is removed from within the larger diameter opening 20*a* by the ultrasonic wave 32. At the same time, it is also possible to remove the foreign matter present on the inner surface of the peripheral portion 13*c* of the mask body such as the clearance between the mask body 13 and the mask frame 14. It should be noted that a part of the ultrasonic wave 32 reflected from the reflecting block 61 irradiates the inner surface of the peripheral portion of the shadow mask 12 in a direction substantially perpendicular to the inner surface noted above so as to facilitate the removal of the foreign matter.

Also, the reflecting block 61 is allowed to perform a reciprocating movement in the axial direction, denoted by the arrow A, of the shadow mask 12 between the shadow mask 12 and the ultrasonic generator 31. As a result, the ultrasonic wave 32 oscillated from the ultrasonic generator 31 is reflected by the reflecting surfaces 62 of the reciprocating reflecting block 61 so as to permit a wide range of the inner surface of the peripheral portion 13*c* of the mask body 13, the inner surface being positioned behind the mask frame 14, to be irradiated with the ultrasonic wave 32. Particularly, since the skirt portion 13*b* of the mask body 13 is irradiated with the ultrasonic wave 32, it is possible to remove without fail the foreign matter such as the splashes clogging the clearance between the mask body 13 and the mask frame 14.

In the third embodiment described above, the reflecting block 61 is made movable. Alternatively, it is possible to make the shadow mask 12 movable with the reflecting block 61 made stationary. Further, it is possible to make both the reflecting block 61 and the shadow mask 12 movable, with substantially the same effect.

Further, it is possible to rotate the reflecting block 61 about the axis 0 parallel to the axial direction of the shadow mask 12 so as to change the distance between each reflecting surface 62 of the reflecting block 61 and the skirt portion 13*b*. In this case, it is possible to improve the cleaning effect by periodically increasing and decreasing the power of the ultrasonic wave 32 irradiating each of the reflecting surfaces 62.

As described above, it is possible to irradiate a wide range of the shadow mask 12 with the ultrasonic wave 32 by relatively changing the positions of the shadow mask 12 and the reflecting block 61 so as to change the position of the shadow mask 12 irradiated with the ultrasonic wave 32 reflected from the reflecting block 61. It is also possible to periodically increase and decrease the power of the ultrasonic wave 32 irradiating the shadow mask 12. It follows that it is possible to improve the cleaning effect.

Incidentally, it is also possible to change the relative positions of the reflecting block 61 and the shadow mask 12 in the second embodiment shown in FIG. 6. In this case, it is possible to obtain the function and effect similar to those obtained in the third embodiment.

Figure 10:
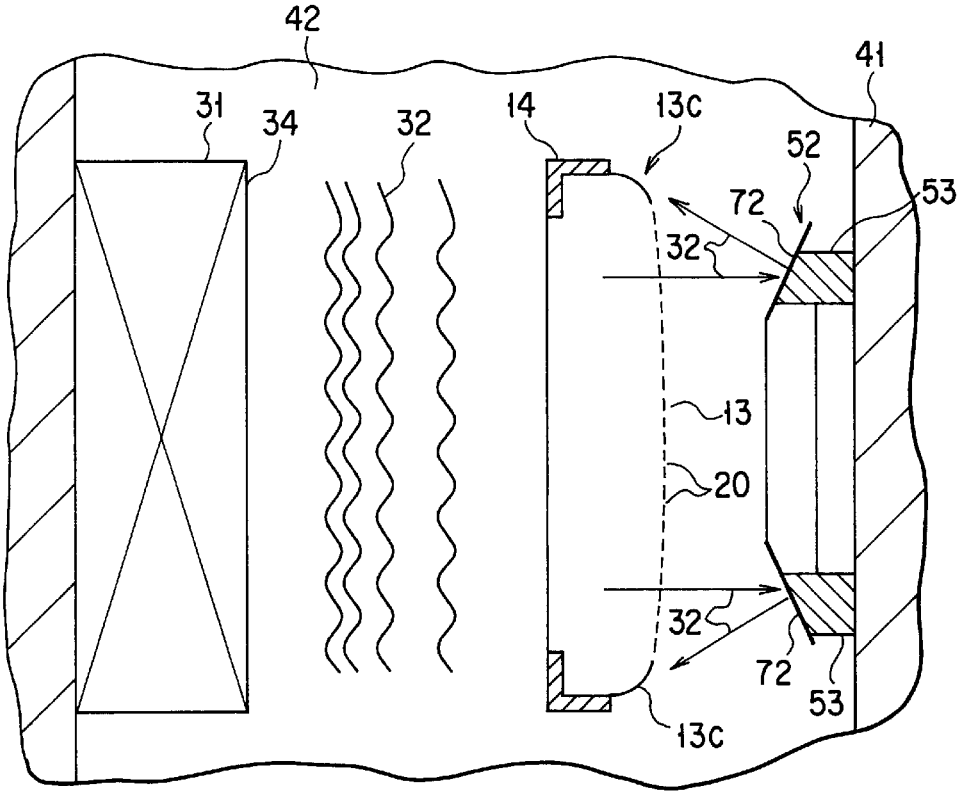
FIG. 10 is a cross sectional view schematically showing the construction of an ultrasonic cleaning apparatus according to a fourth embodiment of the present invention.

An ultrasonic wave cleaning apparatus and an ultrasonic wave cleaning method according to a fourth embodiment of the present invention will now be described with reference to FIG. 10. As shown in FIG. 10, the ultrasonic generator 31 is arranged within the processing vessel 41 in a manner to face the inner surface of the shadow mask 12, and the reflecting plate 52 is arranged to face the outer surface of the shadow mask 12 and is supported by a supporting section 53. The reflecting plate 52, which is made of, for example, a stainless steel, is formed in the shape of a rectangular frame and is sized smaller than the mask frame 14 of the shadow mask 12. The reflecting surface 72 of the reflecting plate 52 is inclined outward relative to the axis of the reflecting plate so as to face the peripheral portion 13*c* of the mask body 13.

In the construction described above, the ultrasonic wave 32 oscillated from the ultrasonic generator 31 irradiates directly the inner surface of the shadow mask 12 and passes through the smaller diameter openings 20*b* and, then, through the larger diameter openings 20*a* of the electron beam passage apertures 20. Where the larger diameter opening 20*a* is clogged with a foreign matter in this case, the foreign matter is removed from within the larger diameter opening 20*a* by the ultrasonic wave 32. On the other hand, a part of the ultrasonic wave 32 passing through the electron beam passage apertures 20 of the shadow mask 12 is reflected by the reflecting surface 72 of the reflecting plate 52 toward the peripheral portion 13*c* of the mask body 13, the peripheral portion 13*c* being positioned behind the mask frame 14. Then, the reflected ultrasonic wave 32 passes through the larger diameter openings 20*a* and, then, through the smaller diameter openings 20*b* of the electron beam passage apertures 20 positioned in the peripheral portion 13*c* of the mask body 13. Where the smaller diameter opening 20*b* is clogged with a foreign matter in this step, the foreign matter is removed from within the smaller diameter opening 20*b* by the ultrasonic wave 32. At the same time, the foreign matter present in the peripheral portion 13*c* of the mask body 13 such as the clearance between the mask body 13 and the mask frame 14 can also be removed by the ultrasonic wave 32.

Figure 11:
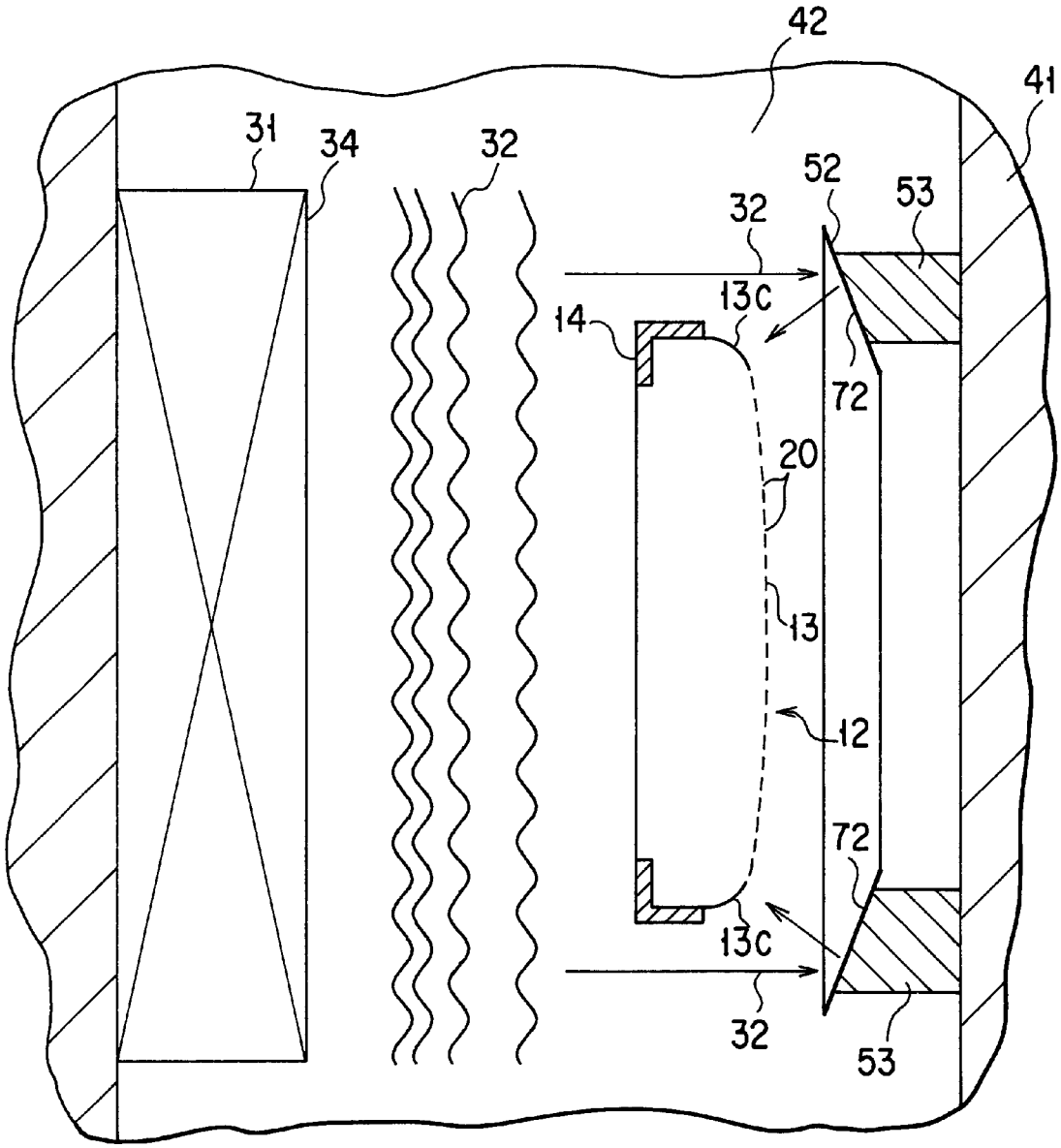
FIG. 11 is a cross sectional view schematically showing the construction of an ultrasonic cleaning apparatus according to a fifth embodiment of the present invention.

FIG. 11 shows a fifth embodiment of the present invention. As shown in the drawing, the reflecting plate 52 arranged to face the outer surface of the shadow mask 12 is supported by the processing vessel 41 via a supporting section 53. The reflecting plate 52, which is made of, for example, a stainless steel, is formed in the shape of a rectangular frame and is sized larger than the mask frame 14 of the shadow mask 12. The reflecting surface 72 of the reflecting plate 52 is inclined inward relative to the axis of the reflecting plate 52 so as to face the peripheral portion 13*c* of the mask body 13. The fifth embodiment is equal to the fourth embodiment described previously in the other constructions.

In the fifth embodiment of the construction described above, it is possible to remove the foreign matter from within the larger diameter openings 20*a* of the electron beam passage apertures 20 by the ultrasonic wave 32 oscillated from the ultrasonic generator 31. Also, a part of the ultrasonic wave 32 passing outside the shadow mask 12 is reflected by the reflecting surface 72 of the reflecting plate 52 toward the peripheral portion 13*c* of the mask body 13, the peripheral portion 13*c* being positioned behind the mask frame 14. Then, the reflected ultrasonic wave 32 passes through the larger diameter openings 20*a* and, then, through the smaller diameter openings 20*b* of the electron beam passage apertures 20 positioned in the peripheral portion of the mask body 13. Where the smaller diameter opening 20*b* is clogged with a foreign matter in this step, the foreign matter is removed from within the smaller diameter opening 20*b* by the ultrasonic wave 32. It is also possible to remove the foreign matter present in the peripheral portion 13*c* of the mask body 13 such as the clearance between the mask body 13 and the mask frame 14.

The fourth and fifth embodiments are equal to the first embodiment in the other constructions and, thus, the detailed description of the overlapping members are omitted.

It is possible to further improve the cleaning effect of the shadow mask by combining appropriately the ultrasonic wave cleaning treatments of the various embodiments described above. For example, the cleaning effect of the shadow mask 12 can be further improved by combining the reflecting block 61 and the reflecting plate 52.

According to each of the embodiments described above, it is possible to wash the shadow mask without fail by effectively utilizing the ultrasonic wave so as to provide a high quality shadow mask free from the clogging. It is also possible to provide a high quality cathode ray tube by using the shadow mask 12 of the present invention for manufacturing the cathode ray tube.

The present invention is not limited to the embodiments described above, and various modifications will be available within the technical scope of the present invention. For example, the ultrasonic wave transmitting medium within the processing vessel 41 is not limited to a liquid such as water. To be sore specific, it is possible to use a gas such as the air as the ultrasonic wave transmitting medium. Where the ultrasonic wave cleaning treatment is carried out within the air, the shadow mask can be irradiated sufficiently with the ultrasonic wave transmitted within the air so as to obtain the function and effect similar to those described above. Also, the shape of the reflecting member is not limited to those exemplified in the embodiments described above. The shape of the reflecting member can be changed in various fashions, as required.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of cleaning a shadow mask including a mask body having electron beam passage apertures formed therein and a frame mask fixed to the peripheral portion of the mask body, the method comprising:

arranging the shadow mask within an ultrasonic wave transmitting medium;

oscillating an ultrasonic wave from an ultrasonic generator toward the shadow mask; and allowing an ultrasonic wave reflector to reflect at least partially the ultrasonic wave oscillated from the ultrasonic generator toward the shadow mask.

2. A method of cleaning a shadow mask according to claim 1, wherein the reflecting of the ultrasonic wave comprises allowing the ultrasonic wave reflector to reflect a part of the ultrasonic wave oscillated from the ultrasonic generator toward the peripheral portion of the shadow mask.

3. A method of cleaning a shadow mask according to claim 1, wherein the reflecting of the ultrasonic wave comprises allowing the ultrasonic waver reflector to reflect the ultrasonic wave passing through the electron beam passage apertures of the shadow mask.

4. A method of cleaning a shadow mask according to claim 1, wherein the reflecting of the ultrasonic wave comprises allowing the ultrasonic wave reflector to reflect a part of the ultrasonic wave oscillated from the ultrasonic generator directly toward the shadow mask.

5. A method of cleaning a shadow mask according to claim 1, wherein the reflecting of the ultrasonic wave comprises allowing the ultrasonic wave reflector to reflect the ultrasonic wave toward the shadow mask while moving the relative positions of the ultrasonic wave reflector and the shadow mask so as to change that area of the shadow mask which is irradiated with the ultrasonic wave.

6. An apparatus of cleaning a shadow mask including a mask body having electron beam passage apertures formed therein and a mask frame fixed to the peripheral portion of the mask body, the apparatus comprising:

a holding section for holding the shadow mask within an ultrasonic wave transmitting medium;

an ultrasonic generator for oscillating an ultrasonic wave toward the shadow mask; and a reflector for reflecting at least partially the ultrasonic wave oscillated from the ultrasonic generator toward the shadow mask.

7. The apparatus of cleaning a shadow mask according to claim 6, wherein the reflector includes a reflecting surface for reflecting a part of the ultrasonic wave oscillated from the ultrasonic generator toward the peripheral portion of the mask body.

8. The apparatus of cleaning a shadow mask according to claim 7, wherein the reflecting surface is inclined relative to the propagating direction of the ultrasonic wave oscillated from the ultrasonic generator.

9. The apparatus of cleaning a shadow mask according to claim 6, wherein the reflector is arranged to face the ultrasonic generator with the shadow mask interposed therebetween and includes a reflecting surface for reflecting a part of the ultrasonic wave passing through the electron beam passage apertures of the shadow mask toward the shadow mask.

10. The apparatus of cleaning a shadow mask according to claim 6, wherein the reflector is arranged between the shadow mask and the ultrasonic generator and includes a reflecting surface for reflecting the ultrasonic wave oscillated from the ultrasonic generator toward the shadow mask.

11. The apparatus of cleaning a shadow mask according to claim 6, which further comprises a driving section for relatively moving the reflector and the shadow mask so as to change that area of the shadow mask which is irradiated with the ultrasonic wave reflected from the ultrasonic wave reflector.

12. The apparatus of cleaning a shadow mask according to claim 6, which further comprises a processing vessel storing an ultrasonic wave transmitting medium, and wherein the ultrasonic generator and the ultrasonic wave reflector are arranged in the processing vessel, and the holding section includes a transfer mechanism for transferring the shadow mask into and out of the processing vessel.

* * * * *